US007688015B2

(12) United States Patent
Wenzel et al.

(10) Patent No.: US 7,688,015 B2
(45) Date of Patent: Mar. 30, 2010

(54) DEVICE FOR MOVING A FIRST FURNITURE PART RELATIVE TO A SECOND FURNITURE PART

(75) Inventors: Holger Wenzel, Lindau (DE); Jürgen Zipp, Braunfels (DE); Steffen Medebach, Wetzlar (DE); Frank Oberpichler, Giessen (DE)

(73) Assignees: Grass GmbH, Hochst (AT); Kuester Automotive Door Systems GmbH, Ehringshausen (DE)

( * ) Notice: Subject to any disclaimer, the term of this patent is extended or adjusted under 35 U.S.C. 154(b) by 0 days.

(21) Appl. No.: 12/243,149

(22) Filed: Oct. 1, 2008

(65) Prior Publication Data

US 2009/0102338 A1 Apr. 23, 2009

Related U.S. Application Data

(63) Continuation of application No. PCT/EP2007/003029, filed on Apr. 4, 2007.

(30) Foreign Application Priority Data

Apr. 4, 2006 (DE) ..... 20 2006 005 577 U

(51) Int. Cl.
*H02P 1/04* (2006.01)
*H02P 5/00* (2006.01)
*G05D 3/00* (2006.01)

(52) U.S. Cl. ..... 318/466; 318/282; 318/283; 318/286; 318/685

(58) Field of Classification Search ..... 318/466, 318/468, 282, 283, 286, 685
See application file for complete search history.

(56) References Cited

U.S. PATENT DOCUMENTS

2004/0100169 A1* 5/2004 Huber et al. ..... 312/319.5
2008/0115417 A1* 5/2008 Huber ..... 49/349

FOREIGN PATENT DOCUMENTS

| | | | |
|---|---|---|---|
| AT | 006 776 | U1 | 3/2004 |
| EP | 1 323 363 | A1 | 7/2003 |
| EP | 1 323 364 | A1 | 7/2003 |
| EP | 1 374 732 | A1 | 1/2004 |
| GB | 2 398 732 | A | 9/2004 |

* cited by examiner

*Primary Examiner*—Bentsu Ro
*Assistant Examiner*—Erick Glass
(74) *Attorney, Agent, or Firm*—Burr & Brown

(57) ABSTRACT

The invention relates to a piece of furniture and to a device for moving a first furniture part relative to a second furniture part using a drive unit by means of which the first furniture part can be moved, in the driven manner, relative to the second furniture part via a monitoring unit for movement monitoring of the first furniture part. In order to adopt a position better between the furniture parts, the monitoring unit is designed to preset a movement of the first furniture part through a predefined movement distance away from a mechanical stop after a movement of the first furniture part to a position which is defined by the mechanical stop, with the first furniture part being locked in the position that is reached, as a final position.

10 Claims, 1 Drawing Sheet

DEVICE FOR MOVING A FIRST FURNITURE PART RELATIVE TO A SECOND FURNITURE PART

CROSS REFERENCE TO RELATED APPLICATIONS

This application is a continuation of International Application No. PCT/EP2007/003029, filed Apr. 4, 2007, which designated the United States, and claims the benefit under 35 USC §119(a)-(d) of German Application No. 20 2006 005 577.0 filed Apr. 4, 2006, the entireties of which are incorporated herein by reference.

FIELD OF THE INVENTION

The invention relates to a device for moving a first furniture part relative to a second furniture part and to a piece of furniture including the device.

BACKGROUND OF THE INVENTION

An arrangement having a movable furniture part in the form of a drawer is known from European Patent Application 1 323 363 A1. The arrangement comprises a drive unit for the drawer and a control device for controlling the drive unit. The arrangement also has a force measurement device. The force measurement device produces a force signal which is characteristic of forces applied to the movable furniture part from the outside, and can be supplied to the control device.

SUMMARY OF THE INVENTION

The invention is based on the object of providing an arrangement of the type described above, in which the first furniture part can adopt a better position with respect to the second furniture part.

The invention is based on a device for moving a first furniture part relative to a second furniture part which comprises a drive unit by means of which the first furniture part can be moved in a driven manner relative to the second furniture part, and a monitoring unit for monitoring the movement of the first furniture part. A primary feature of the invention is that the monitoring unit is designed to preset a movement of the first furniture part through a predefined movement distance away from a mechanical stop after the first furniture part moves to a position which is defined by the mechanical stop, with the first furniture part then being maintained in a motionless state at the position of the predefined movement distance as a final position.

This procedure is based on the recognition that, in the case of driven furniture parts, it is necessary to exactly determine the position of the first (movable) furniture part, in particular with respect to a stationary furniture part, with comparatively high precision, for many applications. When used in kitchens, for example, even a comparatively minor mis-adjustment of the fronts of drawers with respect to one another can be seen from the front of the drawers, and results in a visually undesirable discontinuous impression. This is particularly true in the case of drawers which have no handles but are operated by touch-latch, for which particular attention is normally paid to the fronts. The approach to a mechanical stop and to the final position which is related to the mechanical stop make it possible on the one hand to achieve accurate positioning of the first furniture part and preferably of a front of the first furniture part, and on the other hand, provides a buffer range which can be used for initiation of control actions.

When the first furniture part is closed against the mechanical stop, the drive unit and monitoring unit cooperatively move it away from the mechanical stop by a few millimeters, for example 0.5 to 10 mm, and then stop it at this position as a final position. This process can be carried out with comparatively high precision by reference to the mechanical stop. The process of pushing the first furniture part against the mechanical stop allows the monitoring unit to initiate a control action, for example the opening of the first furniture part and/or the activation of lighting. In this case, for example, it is possible to distinguish between the nature and manner of a pushing-back process by briefly tapping resulting in an opening process whilst, in contrast, pushing back for a somewhat longer time controls a light source.

The drive can be used to detect a control action. For example, pushing the first furniture part back in the direction of the mechanical stop is detected by an increase in current in the drive. However, it is also feasible to detect this movement by means of an incremental transmitter and/or additional elements such as sensors.

The second furniture part, for example an end face of a furniture housing, is preferably used as the mechanical stop.

The furniture parts can move relative to one another using for example, guide means in the form of drawer linear guides or fittings for a furniture door (having a vertical hinge axis) or a furniture hatch (having a vertical hinge axis).

In order to calibrate the system, it is in principle sufficient for the monitoring unit to move the first furniture part against the mechanical stop in the course of a basic setting and for a scaling to be defined with respect to the position of the mechanical stop, for example that of an incremental transmitter, on the basis of which all further positionings of the first furniture part can be carried out.

However, it is preferable that the monitoring unit move the furniture part against the mechanical stop whenever a power failure occurs, in order to allow another adjustment process to be carried out with respect to an absolute value corresponding to the position of the mechanical stop. This increases the accuracy and reliability of the movement of the movable furniture part. This is because movements can occur between furniture parts during a power failure, which are not detected by the system and then cause positioning errors after power is restored.

In order to further improve the position accuracy and reliability of the device, a portion of the second furniture part is used as the mechanical stop and the monitoring unit moves the first furniture part against the mechanical stop and then back to the final position each time the first furniture part is closed. This makes it possible to correct even very minor mechanical changes which can occur during movement of the first furniture part during a single opening and closing process. This ensures exact positioning of the first furniture part.

By way of example, the monitoring unit may be a microcontroller which contains the monitoring device for monitoring and controlling the movement of the first furniture part. It can be integrated in the drive, which allows it to be produced at low cost (mass-produced item), and can be programmed for the existing furniture closure system.

In one preferred embodiment of the invention, the distance to the mechanical stop, that is to say the predetermined movement distance for which the first furniture part moves away from the mechanical stop, is variable and can be programmed in the monitoring unit. This allows mechanical inaccuracies in furniture fronts to be compensated for easily, and individual fronts to be adjusted exactly with respect to a front plane.

An electric motor is preferably used as a drive for the first movable furniture part. However, it is also possible to use a hydraulic or pneumatic drive. Particularly in the case of a hydraulic or pneumatic drive unit, it is possible to use a central drive, in which case appropriate pressure must be applied to the first furniture part just by its supply lines.

The invention also relates to a piece of furniture having furniture parts which can be moved relative to one another and which comprises one of the above-mentioned devices. This allows the advantages which can be achieved by the respective device to be achieved for a piece of furniture having furniture parts which can be moved relative to one another. In particular, the pieces of furniture comprise movable furniture parts such as drawers, doors, hatches and the like which are guided such that they can move via suitable guide devices on a second furniture part, in particular a furniture housing. In particular, guide rails may be used as guide devices for drawers, and, in particular, fittings or hinges may be used for doors or hatches.

BRIEF DESCRIPTION OF THE DRAWINGS

Two exemplary embodiments of the invention will be explained in more detail in the following text with reference to further advantages and details, and are illustrated in the drawings.

DETAILED DESCRIPTION OF THE INVENTION

Figure 1:
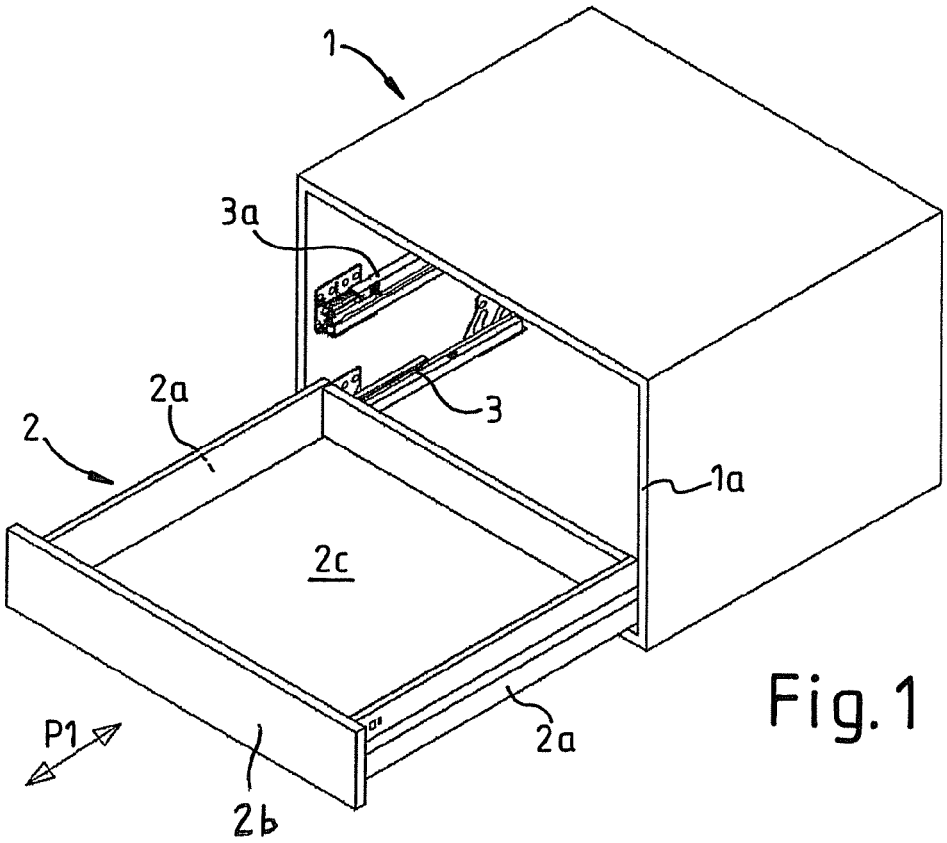
FIG. 1 shows a perspective view of a housing in which a drawer is held by a device according to the invention.

FIG. 1 shows, obliquely from above, a piece of furniture which comprises a housing 1 and a drawer 2 which is guided such that it can move therein. The drawer 2, which is arranged in the lower area of the housing 1, is illustrated in the open or moved-out state. The furniture parts 1 and 2 can be moved with respect to one another via a pulling-out fitting or a drawer guide 3 which is operated by a drive (shown in FIG. 2). A further drawer (not shown) can be accommodated in the housing 1 in the same way via a further drawer guide 3*a*. The drawer 2 can be moved relative to the housing 1 as indicated by the double-headed arrow P1. In order to hold or guide movement of the drawer 2, the drawer guide 3 or 3*a* is accommodated in the lower area of drawer frames 2*a* which project upwards on both sides in a drawer bottom 2*c*, although only the drawer guide 3 or 3*a* can be seen in each case on one inner face of the housing in FIG. 1. The drives preferably act directly on the drawer guides 3, 3*a*. However, it is also possible for one drive to act on the drawer, in this case the drawer rear face, as is illustrated symbolically in FIG. 2. A conventional drawer guide 3 can then be used.

According to the invention, a front 2*b* of the drawer 2 is drawn against an end face 1*a* of the housing 1 when closing, for example by an electrical drive, and is then moved back, by 3 mm, for example, away from the end face 1*a*, for exact, final positioning of the front 2*b*. This then represents the closed position. The upper drawer (not shown) can be fitted above drawer 2 and can be positioned in a corresponding manner or, if geometric requirements make this necessary, can be fitted at a distance from the end wall 1*a* such that the front 2*b* and the front of the upper drawer are exactly aligned.

Figure 2:
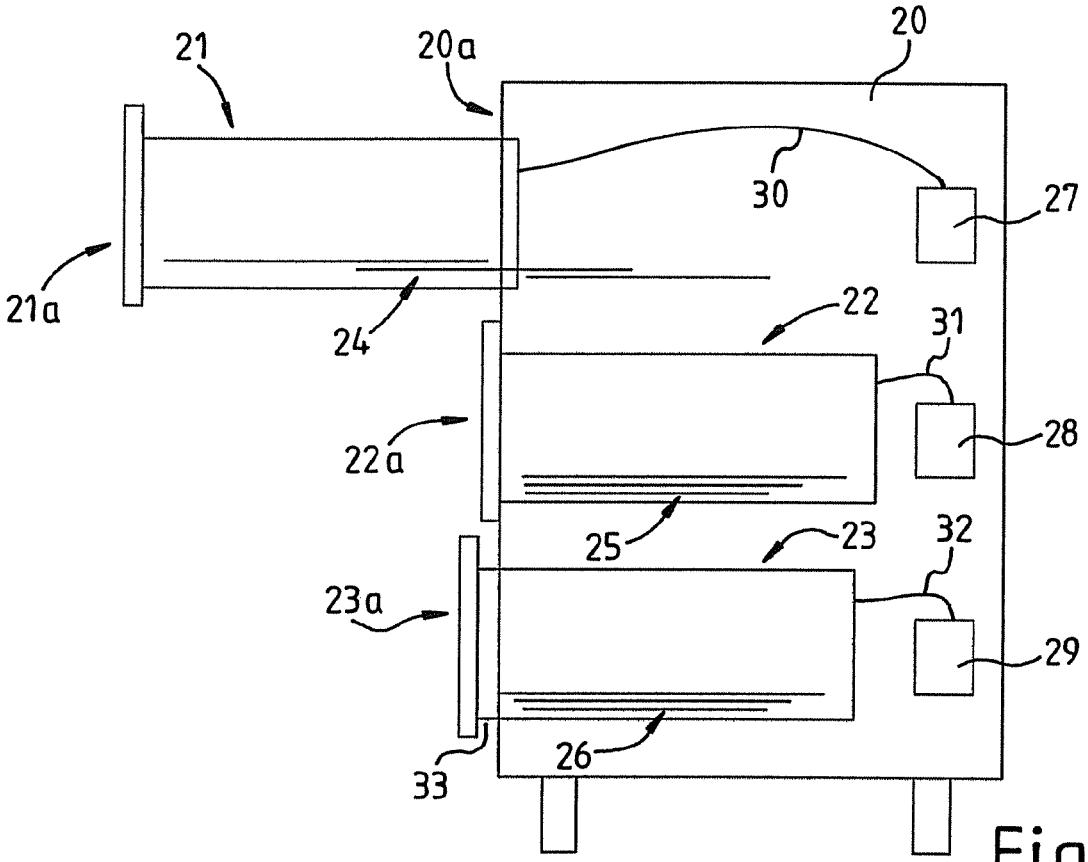
FIG. 2 shows a highly schematic side view of a further exemplary embodiment of a housing having three drawers which are driven according to the invention.

The principle according to the invention is also illustrated in FIG. 2. Drawers 21, 22, 23 are arranged via guides 24, 25, 26 in a housing 20. By way of example, the guides 24, 25, 26 are devices which can be pulled out completely by which means, as illustrated in the case of the drawer 21, the drawer can be completely accessed outside of the housing 20. The drawers 21, 22, 23 are driven via drives, in this case electric motors 27, 28, 29, which are associated with each respective drawer 21, 22, 23. As is illustrated schematically in FIG. 2, each electric motor can be mechanically connected to each respective drawer 21, 22, 23 via a drive element 30, 31, 32, for example a pulling-pushing cable, in order to allow each drawer 21, 22, 23 to be moved in and out completely, in a driven manner.

The electric motors are controlled by the monitoring units that can be integrated in each respective drive. It is also feasible to operate all the drives via one monitoring unit. An incremental transmitter is preferably provided in order to feed back the position of each respective drawer 21, 22, 23 and, for example, is connected to a drive shaft of the respective electric motor, or is arranged directly on the electric motor. The information from the incremental transmitter is transmitted to the respective monitoring unit. In the case of drawers in a housing, it is important, from a visually attractive perspective for the fronts 21*a*, 22*a*, 23*a* of the drawers 21, 22, 23 to be aligned such that they are as flush as possible on one plane when in the closed state. For this purpose, when the drawers are being closed, they are first of all moved against a mechanical stop which in the present case is provided by the end face 20*a* of the housing 20 (shown in FIG. 2 in contact with the drawer 22). From the position of the fronts 21*a*, 22*a*, 23*a* on the end face 20*a*, they are moved back again from the end face 20*a* through a predetermined movement distance 33 (illustrated in FIG. 2 with respect to drawer 23). The predetermined movement distance 33 is preferably individually matched to the respective drawer 21, 22, 23 so as to ensure that the fronts 21*a*, 22*a*, 23*a* are aligned flat.

The distance 33 between the fronts 21*a*, 22*a*, 23*a* and the end face 20*a* can be used in order to integrate a touch-latch function. In this case, the monitoring unit will open the respective drawer by means of the electric motors 27, 28, 29 if the drawer has been manually pushed back into the movement distance 33 in the direction of the end face 20*a*. A corresponding pushing-in movement can be detected, for example, by means of the respective incremental transmitter on the motor, or by other sensors.

LIST OF REFERENCE SYMBOLS

1 Housing
1*a* End face of 1
2 Drawer
2*a* Drawer frame
2*b* Drawer front
2*c* Drawer bottom
3 Drawer guide
3*a* Drawer guide
20 Housing
20*a* End face of 20
21 Drawer
21*a* Drawer front
22 Drawer
22*a* Drawer front
23 Drawer
23*a* Drawer front
24 Guide
25 Guide
26 Guide
27 Electric motor
28 Electric motor

29 Electric motor
30 Drive unit
31 Drive unit
32 Drive unit
33 Movement distance

We claim:

1. A device for moving a first furniture part relative to a second furniture part, comprising a drive unit to move the first furniture part relative to the second furniture part, and a monitoring unit for monitoring the movement of the first furniture part between an open position and a final closed position that is spaced from said open position, wherein each time the first furniture part is closed relative to the second furniture part, the first furniture part contacts a mechanical stop, and then the drive unit and monitoring unit cooperatively move the first furniture part a predefined movement distance away from the mechanical stop to the final closed position where the first furniture part is maintained in a motionless state, wherein the final closed position is an intermediate position between the mechanical stop and the open position.

2. The device as claimed in claim 1, wherein the mechanical stop is a closed position of the first furniture part with respect to the second furniture part.

3. The device as claimed in claim 1, wherein the predefined movement distance through which the first furniture part is moved away from the mechanical stop is at least as great as a movement distance required to initiate a control action by the monitoring unit, said control action being initiated by pushing the first furniture part back from its final position toward the mechanical stop.

4. The device as claimed in claim 3, wherein the control action is initiated via the drive unit.

5. The device as claimed in claim 3, wherein the control action is initiated via a sensor element.

6. The device as claimed in claim 1, wherein the monitoring unit uses contact between the first furniture part and the mechanical stop only for a basic setting.

7. The device as claimed in claim 1, wherein the monitoring unit causes the first furniture part to contact the mechanical stop after a power failure.

8. The device as claimed in claim 1, wherein the predefined movement distance is programmable and stored in the monitoring unit.

9. The device as claimed in claim 1, wherein the drive unit comprises an electric motor.

10. A piece of furniture comprising a device as claimed in claim 1.

* * * * *